US010487575B2

(12) United States Patent
Mugnier et al.

(10) Patent No.: US 10,487,575 B2
(45) Date of Patent: Nov. 26, 2019

(54) METHODS FOR CONFIGURING AND CONTROLLING THE OPERATION OF A MOTORISED DRIVE DEVICE FOR A HOME AUTOMATION UNIT, AND ASSOCIATED UNIT AND MOTORISED DRIVE DEVICE

(71) Applicant: SOMFY ACTIVITES SA, Cluses (FR)

(72) Inventors: David Mugnier, Mont-Saxonnex (FR); Ghislain Goulier, Peillonnex (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 16/086,383

(22) PCT Filed: Mar. 21, 2017

(86) PCT No.: PCT/EP2017/056728
§ 371 (c)(1),
(2) Date: Sep. 19, 2018

(87) PCT Pub. No.: WO2017/162689
PCT Pub. Date: Sep. 28, 2017

(65) Prior Publication Data

US 2019/0119984 A1 Apr. 25, 2019

(30) Foreign Application Priority Data

Mar. 22, 2016 (FR) ..... 16 52446

(51) Int. Cl.
*E06B 9/88* (2006.01)
*E04F 10/06* (2006.01)
(Continued)

(52) U.S. Cl.
CPC ..... *E06B 9/88* (2013.01); *E04F 10/0618* (2013.01); *E04F 10/0629* (2013.01);
(Continued)

(58) Field of Classification Search
CPC ..... E06B 9/88
(Continued)

(56) References Cited

U.S. PATENT DOCUMENTS 6,051,945 A * 4/2000 Furukawa ..... H02H 7/0851 318/264

FOREIGN PATENT DOCUMENTS

EP 2 186 989 A2 5/2010
FR 2 816 465 A1 5/2002

OTHER PUBLICATIONS

International Search Report, dated Jun. 26, 2017, from corresponding PCT/EP2017/056728 application.

* cited by examiner

*Primary Examiner* — David Luo
(74) *Attorney, Agent, or Firm* — Young & Thompson

(57) ABSTRACT

A method for configuring a motorized drive device for a solar protection home automation unit includes a step of triggering the rolling-up of a screen from an unrolled position, in which the screen is relaxed, towards a rolled-up position. This method further includes a step of measuring a magnitude of an electrical current passing through an electric motor using a measurement device, a step of determining a first maximum value of the measured magnitude, indicative of a position of breakage of the arms of a screening device, and a step of determining a lowered end-of-travel position of the screen. The lowered end-of-travel position of the screen corresponds to a measured-magnitude value lower than the first maximum value. The lowered end-of-travel position of the screen lies before the position of breakage of the arms of the screening device, in the direction of unrolling of the screen.

12 Claims, 4 Drawing Sheets

(51) Int. Cl.

| | |
|---|---|
| ***E06B 9/68*** | (2006.01) |
| ***E06B 9/72*** | (2006.01) |
| ***E06B 9/40*** | (2006.01) |
| ***E06B 9/74*** | (2006.01) |

(52) U.S. Cl.
CPC ..... *E04F 10/0651* (2013.01); *E04F 10/0659* (2013.01); *E06B 9/40* (2013.01); *E06B 9/68* (2013.01); *E06B 9/72* (2013.01); *E06B 9/74* (2013.01); *E06B 2009/6845* (2013.01); *E06B 2009/6854* (2013.01); *E06B 2009/6872* (2013.01)

(58) Field of Classification Search
USPC ..... 318/468, 466, 445
See application file for complete search history.

METHODS FOR CONFIGURING AND CONTROLLING THE OPERATION OF A MOTORISED DRIVE DEVICE FOR A HOME AUTOMATION UNIT, AND ASSOCIATED UNIT AND MOTORISED DRIVE DEVICE

The present invention relates to a method for configuring a motorized drive device of a solar protection home automation unit, a method for controlling the operation of such a motorized drive device configured according to the aforementioned configuration method, a motorized drive device of a solar protection home automation unit, and a solar protection home automation unit incorporating such a motorized drive device.

In general, the present invention relates to the field of shading devices, in particular arms awnings, comprising a motorized drive device setting a screen in motion between at least one first position and at least one second position.

A motorized drive device comprises an electromechanical actuator for a movable solar protection element, such as a blind or any other equivalent equipment, hereinafter called screen.

Already known is document FR 2,816,465 A1, which describes a solar protection home automation unit comprising a shading device and a motorized drive device. The shading device comprises a winding tube, a screen, a bar and two arms. A first end of the screen is fastened to the winding tube and a second end of the screen is fastened to the bar. A first end of each of the arms is fastened to the bar and a second end of each of the arms is fastened to a support structure of the shading device. The motorized drive device comprises an electromechanical actuator making it possible to wind and unwind the screen on the winding tube, as well as to fold and unfold the arms. The electromechanical actuator comprises an electric motor, an output shaft connected to the winding tube of the shading device and an electronic control unit. The electronic control unit is connected to a torque sensor, in particular a strain gauge, to measure variations of the torque applied to the winding tube and, subsequently, to the electromechanical actuator during winding and unwinding operations of the screen. The electronic control unit comprises a memory storing one or several values of the measured torque, in particular the maximal torque value exerted on the electromechanical actuator during the unwinding of the screen corresponding to the lower end-of-travel position of the screen, as well as the maximal torque value exerted on the electromechanical actuator during the winding of the screen corresponding to the upper end-of-travel position of the screen.

The two maximal torque values exerted on the motor, corresponding to the lower and upper end-of-travel positions of the screen, are determined via the torque sensor, during a configuration method of the motorized drive device.

However, such a solar protection home automation unit has the drawback of determining the torque value corresponding to the lower end-of-travel position of the screen and by a maximal torque measurement via a torque sensor fastened on a mounting support of the electromechanical actuator.

Consequently, the determination of the lower end-of-travel position of the screen by measuring the maximal value of the torque exerted on the electromechanical actuator using the torque sensor creates an imprecision in this lower end-of-travel position of the screen, since the latter can be moved away from the breakage position of the arms of the shading device or located after this position, in the unwinding direction of the screen.

The breakage position of the arms of the shading device is a position of the shading device in which the arms reach their maximal deployment and where the tension of the screen switches from a tensed state to a non-tensed state, or vice versa.

The breakage position of the arms of the shading device can also be defined as a position in which the torque delivered by the electromechanical actuator of the motorized drive device is maximal, during the unwinding of the screen or during the winding of the screen.

The breakage position of the arms of the shading device can also be called locking position of the arms of the shading device.

Furthermore, such a solar protection home automation unit has the drawback of being expensive and complex to industrialize. It requires dimensioning the motorized drive device to bear the maximal torque, when reaching the lower end-of-travel position of the screen and when starting up the electric motor from this position of the screen.

The present invention aims to resolve the aforementioned drawbacks and to propose a method for configuring a motorized drive device of a solar protection home automation unit, a method for controlling the operation of the motorized drive device configured according to the configuration method of the motorized drive device, an associated motorized drive device and a solar protection home automation unit comprising such a motorized drive device, making it possible to automatically determine a lower end-of-travel position of a screen of a shading device, following the determination of the breakage position of the arms of the shading device.

To that end, the present invention targets, according to a first aspect, a method for configuring a motorized drive device for a solar protection home automation unit, the solar protection home automation unit comprising a shading device, the shading device comprising at least:

- a winding tube,
- a screen, a first end of the screen being fastened to the winding tube,
- a bar, a second end of the screen being fastened to the bar, and
- at least two arms, a first end of each of the arms being fastened to the bar and a second end of each of the arms being fastened to a support structure of the shading device, the motorized drive device comprising at least:

- an electromechanical actuator making it possible to wind and unwind the screen on the winding tube, and to fold and unfold the arms, the electromechanical actuator comprising at least:

- an electric motor,
- an output shaft connected to the winding tube of the shading device, and
- an electronic control unit, the electronic control unit comprising at least:

- a device for measuring a property of an electric current traversing the electric motor, and
- a memory storing at least one value of the measured property.

According to the invention, the configuration method comprises at least the following steps:

- triggering the winding of the screen, from an unwound position, in which the screen is relaxed, to a wound position,
- measuring the property of the electric current traversing the electric motor via the measuring device, determining a first maximal value of the measured property, the first maximal value being representative of a breakage position of the arms of the shading device, and determining a lower end-of-travel position of the screen, where the lower end-of-travel position of the screen corresponds to a value of the measured property below the first maximal value, and where the lower end-of-travel position of the screen is located before the breakage position of the arms of the shading device, in the unwinding direction of the screen.

Thus, the determination of the first maximal value of the measured property, owing to which the breakage position of the arms of the shading device is detected, allows a precise determination of the lower end-of-travel position of the screen.

In this way, the lower end-of-travel position of the screen can be determined so as to be as close as possible to the breakage position of the arms of the shading device.

Furthermore, such a determination of the lower end-of-travel position of the screen makes it possible to guarantee a maximal unwinding of the screen, without reaching the breakage position of the arms of the shading device, when an unwinding command order of the screen is executed by the electromechanical actuator, in a control mode, as well as to guarantee the tension of the screen.

Furthermore, the determination of the lower end-of-travel position of the screen via the determination of the first maximal value of the measured property, representative of the breakage position of the arms of the shading device, makes it possible to guarantee a safe and reproducible positioning of the screen in the lower end-of-travel position of the screen and preceding the breakage position of the arms of the shading device, when an unwinding command order of the screen is executed by the electromechanical actuator.

The determination of the lower end-of-travel position of the screen can thus be done automatically, i.e. by software, and in particular without intervention by the user, during steps of the configuration method following the step for triggering the winding of the screen from an unwound position, in which the screen is relaxed.

Such a configuration method, in which the determination of the lower end-of-travel position of the screen is done by software by the electronic control unit of the electromechanical actuator, makes it possible to minimize the costs for obtaining and commissioning of the motorized drive device and to eliminate additional parts.

According to one preferred feature of the invention, prior to the step for triggering the winding of the screen, the configuration method comprises at least the following steps:

triggering the unwinding of the screen from a wound position to the unwound position, in which the screen is relaxed, and stopping the screen in the unwound position, in which the screen is relaxed.

According to another preferred feature of the invention, following the step for determining the lower end-of-travel position of the screen, the configuration method comprises a step for signaling the determined lower end-of-travel position of the screen.

Advantageously, the determination of the lower end-of-travel position of the screen is done automatically, during steps of the configuration method following the step for triggering the winding of the screen.

According to another preferred feature of the invention, following the step for determining the lower end-of-travel position of the screen, the configuration method comprises at least the following steps:

continuing the winding of the screen, continuing the measurement of the property, determining a second maximal value of the measured property, and determining an upper end-of-travel position of the screen.

Advantageously, the step for measuring the property of the electric current is carried out periodically.

According to a second aspect, the present invention relates to a method for controlling the operation of a motorized drive device of a solar protection home automation unit of the type mentioned above. This control method comprises at least the following steps:

triggering the unwinding of the screen, counting the position of the bar of the screen, comparing a counting value of the position of the bar of the screen relative to a counting increment value corresponding to the determined lower end-of-travel position of the screen, according to a configuration method of the motorized drive device according to the invention, and in particular as previously mentioned, and determining whether the lower end-of-travel position of the screen has been reached or not by the electronic control unit of the electromechanical actuator, based on the results of the comparison step.

Thus, the control method is carried out following the configuration of the motorized drive device, so as to determine, following the comparison of the counting value of the position of the bar of the screen relative to the determined counting increment value, whether the lower end-of-travel position of the screen has been reached or not by the electronic control unit of the electromechanical actuator, based on the results of the comparison.

Preferably, the step for comparing the counting value of the position of the bar of the screen relative to the counting increment value is carried out periodically, as long as the result of the step for whether the lower end-of-travel position of the screen has been reached or not by the electronic control unit of the electromechanical actuator is different from reaching the lower end-of-travel position of the screen.

According to a third aspect, the present invention relates to a motorized drive device of a solar protection home automation unit as mentioned above. This motorized drive device comprises the electronic control unit of the electromechanical actuator configured to carry out the method for configuring the motorized drive device set out above and/or the operation control method mentioned above.

This motorized drive device has features and advantages similar to those described previously in connection with the configuration and operating control methods according to the invention.

According to a fourth aspect, the present invention relates to a solar protection home automation unit comprising a motorized drive device as mentioned above.

Other particularities and advantages of the invention will appear from the description below.

In the appended drawings, provided by way of non-limiting examples:

Figure 1:
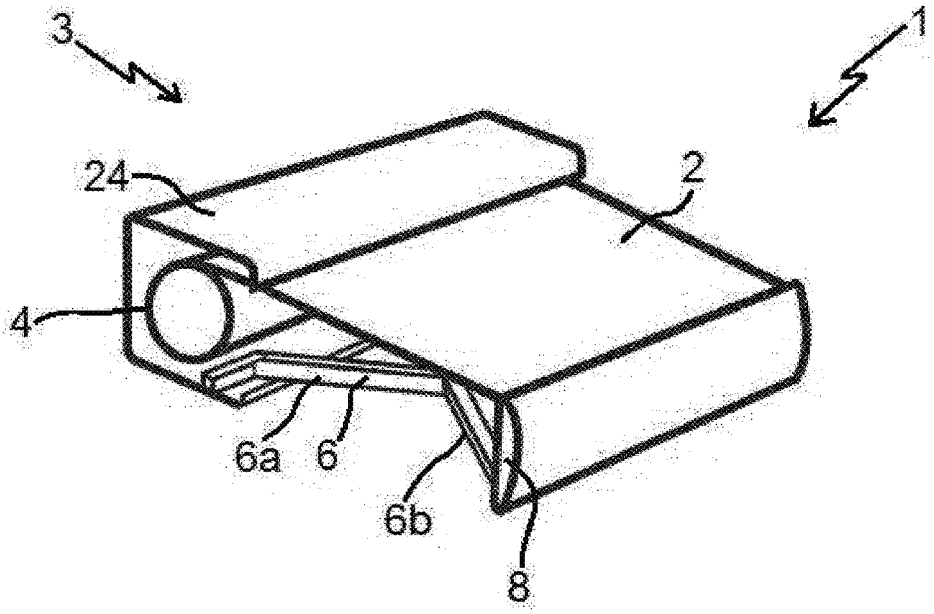
FIG. 1 is a schematic perspective view of a home automation unit according to one embodiment of the invention.
Figure 2:
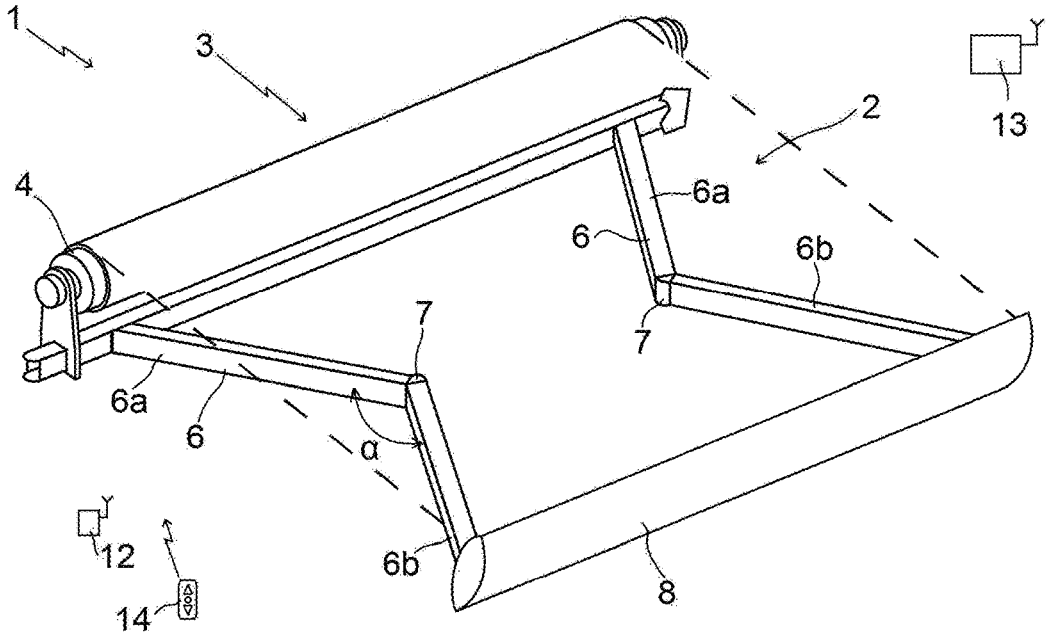
FIG. 2 is a schematic perspective view of the home automation unit illustrated in FIG. 1, where a box of the shading device has been removed and where a screen is shown partly transparently.
Figure 3:
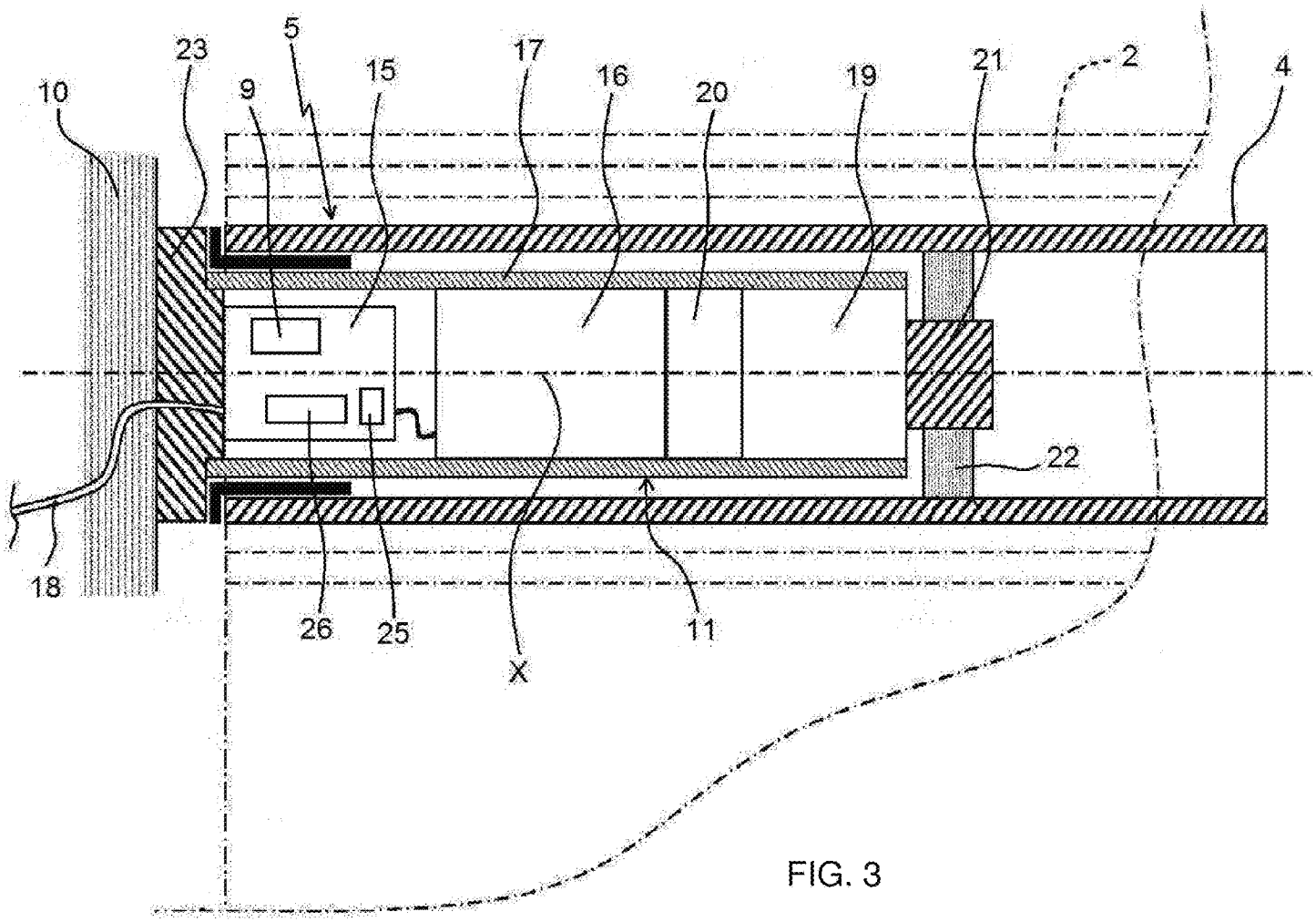
FIG. 3 is a partial sectional and longitudinal schematic view of the home automation unit illustrated in FIGS. 1 and 2.
Figure 4:
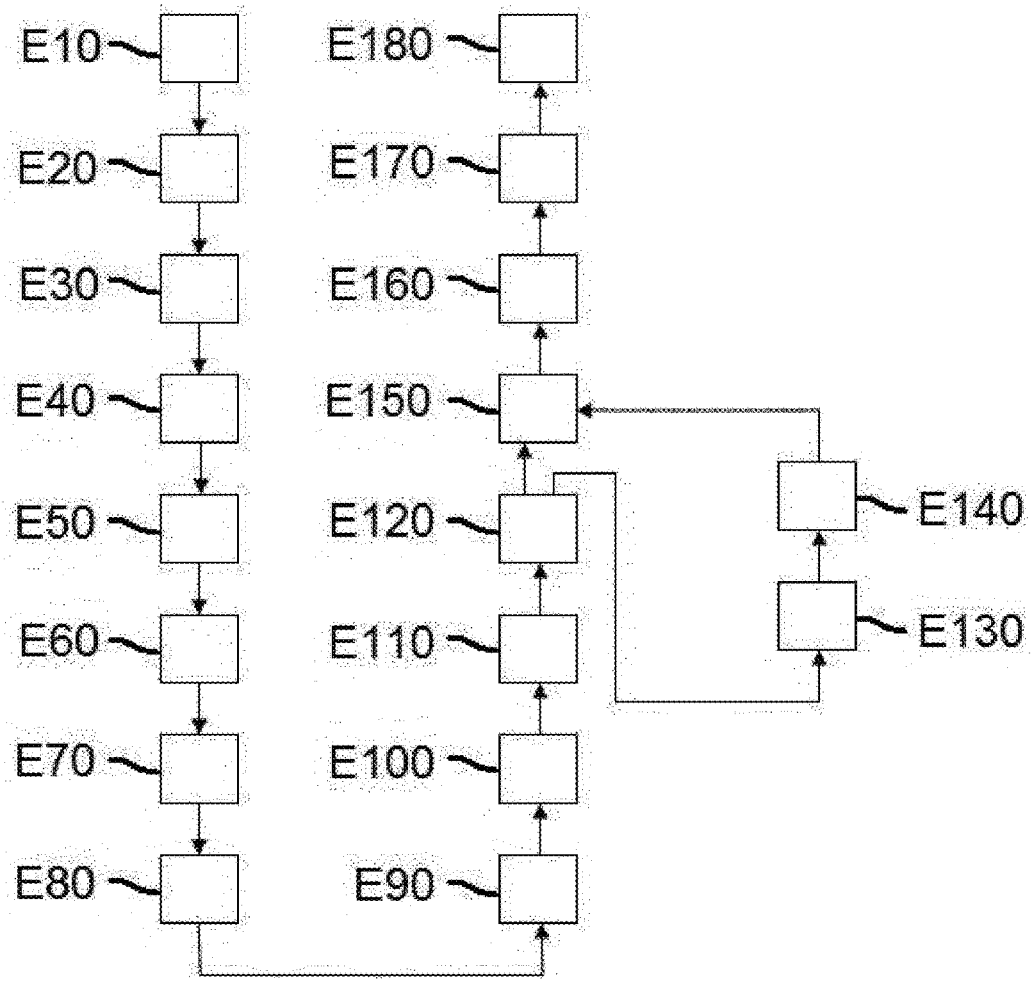
FIG. 4 is a block diagram of an algorithm of the method according to the invention, for configuring a motorized drive device of the home automation unit illustrated in FIGS. 1 to 3.
Figure 5:
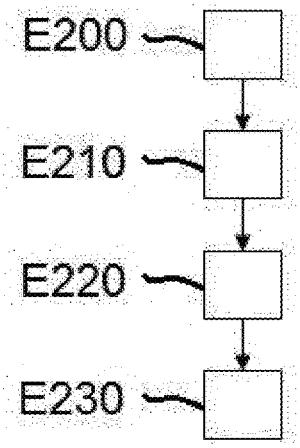
Figure 6:
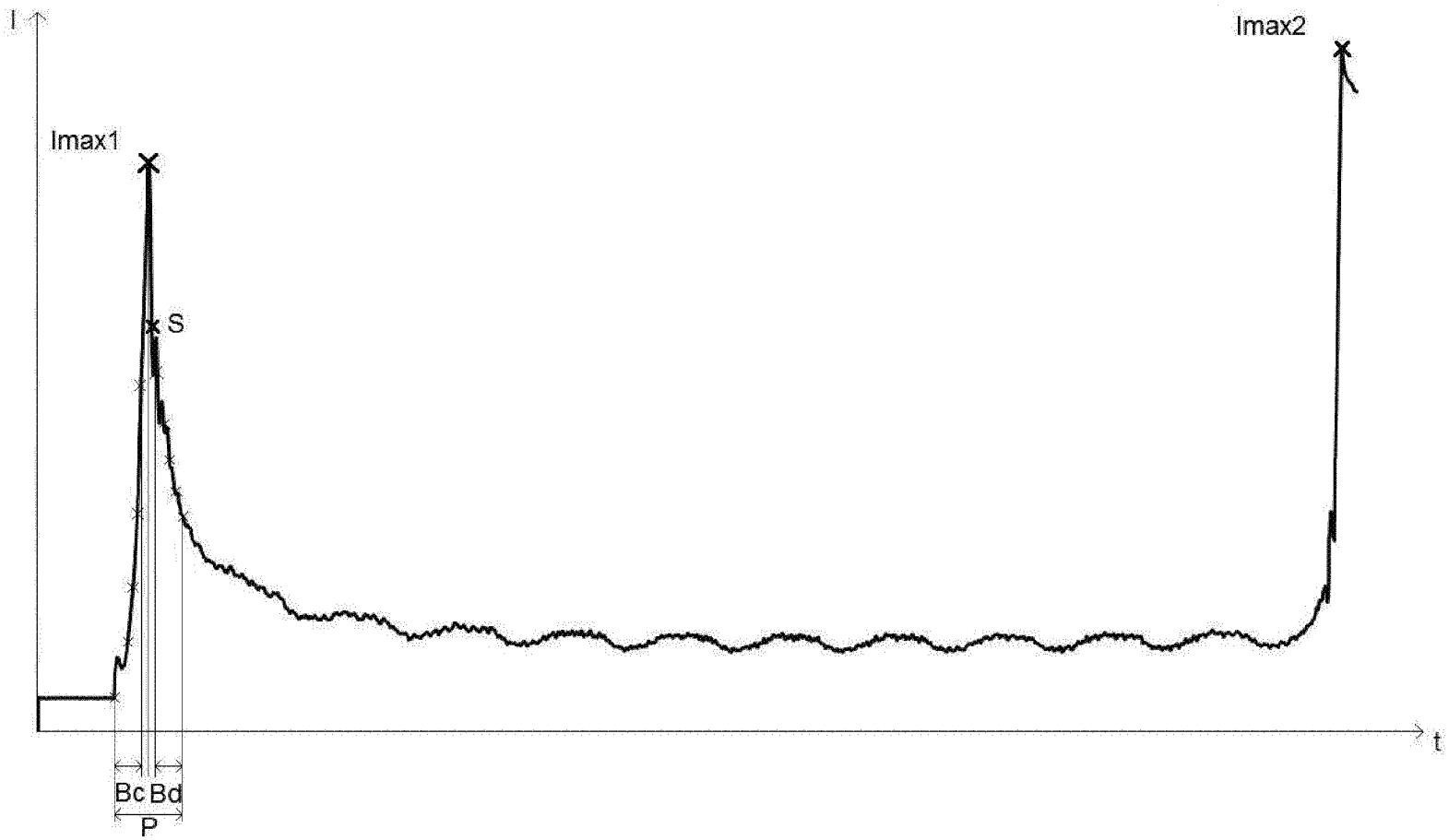

FIG. 5 is a block diagram of an algorithm of a method according to the invention, for controlling the operation of the motorized drive device of the home automation unit illustrated in FIGS. 1 to 3; and FIG. 6 is a graph showing the evolution of a property of an electric current traversing electric motor of the electromechanical actuator of the motorized drive device as a function of time, when the configuration method, as illustrated in FIG. 4, is implemented.

We first describe, in reference to FIGS. 1 to 3, a home automation unit 1 according to the invention and installed on a building, not shown, equipped with a screen 2 belonging to a shading device 3, in particular a motorized arms awning.

The shading device 3 may advantageously be arranged above a terrace.

In reference to FIGS. 1 and 2, an arms awning according to one embodiment of the invention is described.

The screen 2 of the shading device 3 is wound on a winding tube 4 driven by a motorized drive device 5 and movable between a wound position, in particular upper, and an unwound position, in particular lower.

The moving screen 2 of the shading device 3 is a solar protection screen, winding on the winding tube 4, the inner diameter of which is substantially equivalent to the outer diameter of an electromechanical actuator 11, such that the electromechanical actuator 11 can be inserted into the winding tube 4, during the assembly of the shading device 3.

The motorized drive device 5 comprises the electromechanical actuator 11, in particular of the tubular type, making it possible to rotate the winding tube 4, so as to unwind or wind the screen 2 of the shading device 3.

The shading device 3 comprises the winding tube 4 in order to wind the screen 2, where, in the mounted state, the electromechanical actuator 11 is inserted into the winding tube 4.

The shading device 3 also comprises a bar 8 and two arms 6.

Alternatively, the shading device 3 may comprise more than two arms 6, in particular a number depending on the dimensions of the screen 2.

The arms 6 of the shading device 3 are articulated, and more particularly, configured to be folded or unfolded depending on the winding or unwinding of the screen 2.

Each arm 6 of the shading device 3 comprises two arm segments 6*a*, 6*b*. One end of a first arm segment 6*a* is connected to one end of the second arm segment 6*b* via an articulation 7.

In this way, the articulation 7 of each arm 6 is arranged between the two arm segments 6*a*, 6*b* and, advantageously, in the central part, so as to allow pivoting of the two arm segments 6*a*, 6*b* relative to one another around a rotation axis. The angle defined between the two arm segments 6*a*, 6*b* is denoted a.

In a known manner, the arms awning, which forms the shading device 3, comprises a canvas, forming the screen 2 of the winding blind 3. A first end of the screen 2, in particular the upper end of the screen 2 in the assembled configuration of the shading device 3 in the home automation unit 1, is fastened to the winding tube 4. Furthermore, a second end of the screen 2, in particular the lower end of the screen 2 in the assembled configuration of the shading device 3 in the home automation unit 1, is fastened to the bar 8.

Furthermore, a first end of each of the arms 6, in particular the upper end of each of the arms 6 in the assembled configuration of the shading device 3 in the home automation unit 1, is fastened to a support structure of the shading device 3. Additionally, a second end of each of the arms 6, in particular the lower end of each of the arms 6 in the assembled configuration of the shading device 3 in the home automation unit 1, is fastened to the bar 8.

The support structure is configured to be fastened on a wall of the building, in particular by fastening elements by screwing.

The support structure can be made using a box 24 and/or supports arranged respectively at each end of the winding tube 4.

Each arm 6 comprises a spring, not shown, such that the screen 2 deploys under the effect of the springs. The spring of each arm 6 is compressed, when the arms 6 are in the unfolded position.

Each arm 6 also comprises a stop mechanism, not shown, which may be adjustable. This stop mechanism of an arm 6 makes it possible to deliver the maximal angular displacement travel of the first arm segment 6*a* relative to the second arm segment 6*b*. The value of the maximal angular displacement travel of the first arm segment 6*a* relative to the second arm segment 6*b* is advantageously less than 180° and preferably less than 150°.

Here, the canvas forming the screen 2 is made from a textile material. Furthermore, such a canvas forming the screen 2 is provided to be impermeable to water and air, in other words resistant to rain and wind.

In one example embodiment that is not shown, the first end of the screen 2 has a hem through which a rod is positioned, and in particular made from plastic. This hem made at the first end of the screen 2 is obtained using a seam of the canvas forming the screen 2. During the assembly of the screen 2 on the winding tube 4, the hem and the rod located at the first end of the screen 2 are inserted by sliding in a slot arranged on the outer face of the winding tube 4, in particular over the entire length of the winding tube 4, so as to be able to wind and unwind the screen 2 around the winding tube 4.

In the case of an arms awning, the wound position corresponds to the bearing of the bar 8 against an edge of a box 24 of the arms awning 3, and the unwound position corresponds to a position preceding the breakage of the arms 6, in which the screen 2 is stretched.

Here, the winding tube 4 is positioned inside the box 24 of the winding blind 3. The screen 2 of the winding blind 3 winds and unwinds around the winding tube 4 and is housed at least partly inside the box 24.

In general, the box 24 is positioned above an opening, not shown, arranged in the building.

The motorized drive device 5 is controlled by a control unit. The control unit can for example be a local control unit 12, where the local control unit 12 can be connected by a wired or wireless link with a central control unit 13. The central control unit 13 controls the local control unit 12, as well as other similar local control units distributed in the building.

The central control unit 13 can be in communication with a weather station off boarded outside the building, in particular including one or several sensors able to be configured for example to determine a temperature, a brightness, or a wind speed.

A remote control 14, which may be a type of local control unit, and provided with a control keypad, which comprises selection and display elements, further allows a user to intervene on the electromechanical actuator 11 and/or on the central control unit 13.

The motorized drive device 5 is preferably configured to execute the unwinding or winding commands of the screen 2 of the shading device 3 able to be emitted, in particular, by the remote control 14.

The electromechanical actuator 11 comprises an electric motor 16. The electric motor 16 comprises a rotor and a stator, not shown and positioned coaxially around a rotation axis X, which is also the rotation axis of the winding tube 4 in the mounted configuration of the motorized drive device 5, as illustrated in FIG. 3.

Control means of the electromechanical actuator 11 according to the invention, allowing the displacement of the screen 2 of the shading device 3, comprise at least one electronic control unit 15. This electronic control unit 15 is able to operate the electric motor 16 of the electromechanical actuator 11, and in particular to allow the supply of electric energy for the electric motor 16.

Thus, the electronic control unit 15 in particular controls the electric motor 16, so as to unwind or wind the screen 2, as previously described.

The electronic control unit 15 also comprises an order receiving module, in particular for radioelectric orders emitted by an order emitter, such as the remote control 14 intended to control the electromechanical actuator 11 or one of the local 12 or central 13 control units.

The order receiving module can also make it possible to receive orders sent through wired means.

When an unwinding order of the screen 2 is received by the electronic control unit 15, the electromechanical actuator 11 rotates the winding tube 4 in a first direction, called deployment direction of the screen 2, and frees the arms 6, so as to unfold them, in particular under the action of springs.

When a winding order of the screen 2 is received by the electronic control unit 15, the electromechanical actuator 11 rotates the winding tube 4 in a second direction, called folding direction of the screen 2, and folds the arms 6, in particular by compressing the springs.

The electronic control unit 15 is configured to stop the electromechanical actuator automatically, following the reception of a stop command order able to be emitted by the control unit 12, 13, 14, or following the determination that a lower end-of-travel position has been reached, in other words that the screen 2 is completely unwound, or an upper end-of-travel position, in other words that the screen 2 is completely wound.

Here, and as illustrated in FIG. 3, the electronic control unit 15 is arranged inside a casing 17 of the electromechanical actuator 11.

The control means of the electromechanical actuator 11 comprise hardware and/or software means.

By way of non-limiting example, the hardware means may comprise at least one microcontroller.

We now describe, in more detail and in reference to FIG. 3, the electromechanical actuator 11 belonging to the home automation unit 1 of FIGS. 1 and 2.

The electromechanical actuator 11 is supplied with electrical energy by an electric grid of the sector, or by a battery, which can be recharged, for example, by a photovoltaic panel. The electromechanical actuator 11 makes it possible to move the screen 2 of the shading device 3.

Here, the electromechanical actuator 11 comprises a power cable 18 allowing it to be supplied with electrical energy from the electrical grid of the sector.

The casing 17 of the electromechanical actuator 11 is preferably cylindrical.

In one embodiment, the casing 17 is made from a metal material. The material of the casing of the electromechanical actuator is in no way limiting and can be different. It may in particular be a plastic.

Here, the electric motor 16 is of the brushless direct-current (BLDC) or "synchronous permanent magnet" type.

The electronic control unit 15 of the electromechanical actuator 11 comprises a circuit, not shown, for rectifying alternating voltage of the electric grid and an electric supply module, not shown. The electric supply module is thus electrically connected to a direct voltage source +Vbus. The value of the direct voltage +Vbus is defined relative to a reference voltage Gnd.

The electrical supply module supplies electrical energy, sequentially, to coils of the electric motor 16, so as to produce a rotary electromagnetic field causing the rotor of the electric motor 16 to be rotated.

The electric supply module comprises switches making it possible to supply electricity to the windings sequentially.

Here, the switches of the electrical supply module are transistors of the MOSFET type (acronym for the term Metal Oxide Semiconductor Field Effect Transistor), and there are six. The type of switches of the electrical supply module and their number are in no way limited. In particular, the switches of the electrical supply module can be transistors of the IGBT (Insulated Gate Bipolar Transistor) type.

The electromechanical actuator 11 also comprises a reducing gear device 19, a brake 20 and an output shaft 21.

Advantageously, the electric motor 16, the reducing gear device 19 and the brake 20 are arranged inside the casing 17 of the electromechanical actuator 11.

The brake 20 of the electromechanical actuator 11 is configured to block the rotation of the output shaft 21, so as to regulate the rotation speed of the winding tube 4, during a movement of the screen 2, and to keep the winding tube 4 blocked, when the electromechanical actuator 11 is stopped.

The output shaft 21 of the electromechanical actuator 11 is arranged inside the winding tube 4, and at least partly outside the casing 17 of the electromechanical actuator 11.

The output shaft 21 of the electromechanical actuator 11 is coupled by a connecting means 22 to the winding tube 4, in particular a wheel-forming connecting means.

The electromechanical actuator 11 also comprises a closing element 23 at one end of the casing 17.

Here, the casing 17 of the electromechanical actuator 11 is fastened to a support 10, in particular a flange, of the box 24 of the shading device 3 using the closing element 23 forming a torque support, in particular a closing and torque reacting head. In such a case where the closing element 23 forms a torque support, the closing element 23 is also called a "fixed point" of the electromechanical actuator 11.

The electronic control unit 15 of the electromechanical actuator 11 comprises an obstacle and end-of-travel detection device during the winding of the screen 2 and during the unwinding of this screen 2.

The obstacle and end-of-travel detection device during the winding and during the unwinding of the screen 2 is implemented using a microcontroller 9 of the electronic control unit 15, and in particular using an algorithm implemented by this microcontroller 9.

The electronic control unit 15 comprises a device 25 for measuring a property I of an electric current traversing the electric motor 16 and a memory 26 storing one or several values of the measured property I.

The acquisition of the property I of the electric current traversing the electric motor 16 via the measuring device 25 makes it possible to obtain a signal representative of the torque generated by the electric motor 16 of the electromechanical actuator 11.

In one embodiment, the property I of the electric current traversing the electric motor 16 measured by the measuring device 25 is an intensity.

Within the meaning of the present invention, the intensity of the electric current traversing the electric motor 16 is the intensity of an electric current traversing this electric motor 16 during operation. The intensity of the electric current traversing the electric motor 16 is obtained using a positive rectified signal taking into consideration the current of each of the windings of the electric motor 16.

The acquisition of the intensity value of the electric current traversing the electric motor 16 via the measuring device 25 makes it possible to obtain a signal representative of the torque generated by the electric motor 16 of the electromechanical actuator 11.

Here, the measuring device 25 of the intensity value is implemented using a resistance, called "shunt", electrically connected to the electrical supply module and the reference voltage Gnd.

The measuring device 25 is an integral part of a signal generator. This signal generator also comprises an analog filter, in particular a low-pass RC circuit, the RC circuit being made up of a resistance and a capacitance.

The signal generator makes it possible to deliver a signal representative of the electrical supply provided to the electric motor 16, in particular the intensity of the electric current traversing the electric motor 16, at an input of the microcontroller 9 of the electronic control unit 15. The input of the microcontroller 9 comprises an analog/digital converter.

The signal of the intensity value acquired by the measuring device 25 is also processed digitally by at least one digital filter, for example able to be a low-pass filter, implemented by the microcontroller 9.

Here, the memory storing the property I of the electric current traversing the electric motor 16 is done by a memory of the microcontroller 9 of the electronic control unit 15, in particular a memory of the "EEPROM" type (acronym for the term Electrically Erasable Programmable Read Only Memory).

The motorized drive device 5 is provided to operate at least in a control mode and in a configuration mode.

The selection of the electromechanical actuator 11 for the shading device 3 is implemented by calculating the torque of the electromechanical actuator 11, in particular by the installer, based on the size of the shading device 3, and in particular, using an abacus taking into consideration the weight of the bar 8 and the diameter of the winding tube 4.

We now describe, in reference to FIG. 4, one embodiment of a method for configuring the motorized drive device 5 of the home automation installation 1 illustrated in FIGS. 1 to 3.

In FIG. 6, the graph illustrates, using a curve in solid lines, the evolution of the value of the intensity I of the electric current traversing the electric motor 16, as a function of time t.

This FIG. 6 is a characteristic depiction of the evolution of the torque delivered by the electric motor 16 of the electromechanical actuator 11 as a function of time for an arms awning 3, during the winding of the screen 2 from an unwound position, in which the screen 2 is relaxed, to the wound position, in which the bar 8 connected to the screen 2 is bearing on the box 24.

The time t is shown on the x-axis, and the value of the intensity I of the electric current traversing the motor 16 is shown on the y-axis.

In this embodiment, the configuration method of the motorized drive device 5 of the home automation unit 1 comprises a step E10 for entering the configuration mode of the motorized drive device 5.

The entry into the configuration mode of the motorized drive device 5 can be done by switching between the control mode and the configuration mode of the motorized drive device 5.

Advantageously, the electronic control unit 15 of the electromechanical actuator 11 is configured to switch from a control mode of the motorized drive device 5 to a configuration mode of the motorized drive device 5, and vice versa.

In one embodiment, the step E10 for entering the configuration mode of the motorized drive device 5 is carried out by pressing on the programming selection element of a control point 12, 14, in particular of the remote control 14.

In another embodiment, the step E10 for entering the configuration mode of a motorized drive device 5 is carried out by simultaneously pressing on two selection elements of a control point 12, 14, in particular of the remote control 14, for example the winding and unwinding selection elements of the screen 2.

Following the entry into the configuration mode of the motorized drive device 5, the method comprises a step E20 for signaling the configuration mode.

In practice, the signaling step E20 is carried out by a movement of the screen 2 controlled by the motorized drive device 5.

Preferably, the movement of the screen 2 corresponds to a round-trip movement of the screen 2, in particular over a short distance that may for example be about a centimeter.

Here, the signaling step E20 is carried out after the step E10 for entering the configuration mode of the motorized drive device 5.

After the signaling step E20 of the configuration mode, the method comprises a step E30 for triggering the unwinding of the screen 2 from a wound position to an unwound position, in which the screen 2 is relaxed.

The step E30 for triggering the unwinding of the screen 2 is carried out by activating the motorized drive device 5, so as to deploy the screen 2, as well as the arms 6.

In one embodiment, the activation of the motorized drive device 5 is done by pressing on a selection element of a control point 12, 14, in particular of the remote control 14.

Here, the selection element of the control point 12, 14 is the unwinding selection element of the screen 2.

Alternatively, the activation of the motorized drive device 5 is carried out automatically by the electronic control unit 15, following the step E20 for signaling the configuration mode.

Following the activation of the motorized drive device 5, the movement of the screen 2 is carried out to an unwound position, in which the screen 2 is relaxed.

The unwound position of the screen 2, in which the screen 2 is relaxed, is obtained by positioning the two arm segments 6*a*, 6*b* of each of the two arms 6 abutting against one another, in particular using the stop mechanism, then keeping the motorized drive device 5 activated for a minimal period of time, so as to unwind the screen 2 around the winding tube 4.

Thus, when the two arm segments 6*a*, 6*b* of each of the two arms 6 are abutting against one another, the screen 2 continues to unwind, by keeping the motorized drive device 5 activated, although the bar 8 of the screen 2 is blocked.

In this way, after the step E30 for triggering the unwinding of the screen 2, the screen 2 is unwound and relaxed.

By way of non-limiting example, the minimal period of time during which the motorized drive device 5 is kept activated is about one to several seconds.

Advantageously, the length of the screen 2 remaining wound around the winding tube 4, before the minimal period of time for keeping the motorized drive device activated 5, so as to reach the unwound position of the screen 2, in which the screen 2 is relaxed, is greater than the unwound screen 2 length during the minimal period of time.

Then, the method comprises a step E40 for stopping the screen 2 in the unwound position, in which the screen 2 is relaxed.

The step E40 for stopping the screen 2 in the unwound position, in which the screen 2 is relaxed, is carried out by deactivating the motorized drive device 5.

In one embodiment, the stopping of the screen 2 in the unwound position, in which the screen 2 is relaxed, is carried out by pressing on a selection element of a control point 12, 14, in particular of the remote control 14.

Here, the selection element of the control point 12, 14 is the stop selection element of the screen 2.

Alternatively, the stopping of the screen 2 in the unwound position, in which the screen 2 is relaxed, is done automatically by the electronic control unit 15 and the measuring device 25, in particular when values of the property I measured by the measuring device 25 are constant for a predetermined period of time, in particular within a range of values, and below a threshold value.

In such a case, following the step E30 for triggering the unwinding of the screen 2, the method comprises a step for measuring the property I of the electric current traversing the electric motor 16, by the measuring device 25.

Following the step E40 for stopping the screen 2, the method comprises a step E50 for triggering the winding of the screen 2 from the unwound position, in which the screen 2 is relaxed, toward a wound position.

The step E50 for triggering the winding of the screen 2 from the unwound position, in which the screen 2 is relaxed, is carried out by activating the motorized drive device 5, so as to fold the screen 2, as well as the arms 6.

In one embodiment, the activation of the motorized drive device 5 is implemented by pressing on a selection element of a control point 12, 14, in particular the remote control 14.

Here, the selection element of the control point 12, 14 is the selection element of the winding of the screen 2.

Alternatively, the activation of the motorized drive device 5 is implemented automatically by the electronic control unit 15, following the step E40 for stopping the screen 2 in the unwound position, in which the screen 2 is relaxed.

Then, the method comprises a step E60 for measuring the property I of the electric current traversing the electric motor 16 by the measuring device 15, as illustrated in FIG. 6, and a step E80 for determining a first maximal value Imax1 of the measured property I. The first maximal value Imax1 of the measured property I is represented of the breakage position of the arms 6 of the shading device 3. In practice, the step E80 for determining the first maximal value Imax is carried out using the electronic control unit 15, and in particular, the measuring device 25 and the microcontroller 9 of the electronic control unit 15.

As mentioned above, the breakage position of the arms 6 of the shading device 3 is a position of the shading device 3 in which the arms 6 reach their maximal deployment and where the tension of the screen 2 switches from a stretched state to a non-stretched state, or vice versa.

The breakage position of the arms 6 of the shading device 3 can also be defined as a position in which the torque delivered by the electromechanical actuator 11 of the motorized drive device 5 is maximal, during the unwinding of the screen 2 or during the winding of the screen 2.

The breakage position of the arms 6 of the shading device 3 can also be called locking position of the arms 6 of the shading device 3.

The startup of step E60 for measuring the property I of the electric current traversing the electric motor 16 from the unwound position, in which the screen 2 is relaxed, toward a wound position, makes it possible to guarantee that the first maximal value Imax1 of the property I, determined during step E80, indeed corresponds to the breakage position of the arms 6 of the shading device 3, and not to another position of the screen 2.

Furthermore, the execution of the step E50 for triggering the winding of the screen 2, from the unwound position, in which the screen 2 is relaxed, toward a wound position, makes it possible to activate the motorized drive device 5 with a value of the property I of the electric current traversing the electric motor 16 that is low, or in other words with a minimal torque value.

Advantageously, the step E60 for measuring the property I of the electric current is carried out periodically.

By way of non-limiting example, the step E60 for measuring the property I is carried out every 5 milliseconds.

The use of the measurement of the property I, in particular the intensity, of the electric current traversing the electric motor 16 makes it possible to determine a sampling frequency based on the desired determination precision of the first maximal value Imax1 of the property I. This sampling frequency of the property I of the electric current traversing the electric motor 16 is thus independent of the voltage of the electric supply grid of the electromechanical actuator 11, and in particular its frequency.

Advantageously, the step E80 for determining the first maximal value Imax1 is reiterated with each new measurement of the property I of the electric current, in step E60.

The method comprises a step E70 for storing values of the measured property I, according to a predetermined frequency.

Advantageously, the step E70 for storing values of the measured property I is carried out according to the implementation frequency of the step E60 for measuring the property I of the electric current.

The values of the measured property I, stored during step E70, are kept for a predetermined period of time P, during the winding of the screen 2, following the step E50 for triggering the winding of the screen 2.

The step E70 is carried out after step E60 and before step E80.

The maximal value Imax1 is determined, during step E80, from values of the stored property I, during step E70, during the predetermined period of time. Advantageously, the values of the measured property I belonging to the predetermined period of time and making it possible to determine the maximal value Imax1 are stored temporarily in at least one buffer memory of the electronic control unit 15, in particular the microcontroller 9.

In one embodiment, the values of the measured property I belonging to the predetermined period of time P and making it possible to determine the maximal value Imax1 are separated into a first and second series of values Bd, Bc of the property I measured and stored temporarily into buffer memories of the electronic control unit 15, in particular of the microcontroller 9, in a chronological order. The first and second series of values Bd, Bc of the measured property I comprise successive values measured by the measuring device 25. The values of the measured property I of the first series of values Bd are measured before the values of the measured property I of the second series of values Bc, in the winding direction of the screen 2.

The first and second series of values Bd, Bc of the measured property I can comprise an identical or different number of values.

Here, the step E80 for determining the first maximal value Imax1 is carried out by selecting a value of the measured property I located between the first series of values Bd and the second series of values Bc, then comparing this value of the measured property I, on the one hand, with the last value of the first series of values Bd, and on the other hand, with the first value of the second series of values Bc.

In the case where the selected value of the measured property I is greater than the last value of the first series of values Bd and greater than the first value of the second series of values Bc, the selected value of the measured property I can be determined as being the first maximal value Imax1.

This result of the comparison of the selected value of the measured property I, on the one hand, with the last value of the first series of values Bd and, on the other hand, with the first value of the second series of values Bc, is a first condition for determining the first maximal value Imax1.

Otherwise, the selected value of the measured property I is determined as being different from the first maximal value Imax1.

Furthermore, the step E80 for determining the first maximal value Imax1 is optionally carried out by comparing the selected value of the measured property I, on the one hand, with the first value of the first series of values Bd, and on the other hand with the last value of the second series of values Bc.

In the case where a deviation between the selected value of the measured property I and the first value of the first series of values Bd is negative and where a deviation between the selected value of the measured property I and the last value of the second series of values Bc is positive, the selected value of the measured property I can be determined as being the first maximal value Imax1.

This result of the comparison of the selected value of the measured property I, on the one hand, with the first value of the first series of values Bd, and on the other hand with the last value of the second series of values Bc, is a second condition for determining the first maximal value Imax1.

Otherwise, the selected value of the measured property I is determined as being different from the first maximal value Imax1.

The determination of a deviation between the selected value of the measured property I and the first value of the first series of values Bd and the determination of a deviation between the selected value of the measured property I and the last value of the second series of values Bc are implemented by the electronic control unit 15.

Advantageously, the step E80 for determining the first maximal value Imax1 is implemented until obtaining first and second conditions for determining the first maximal value Imax1.

The obtaining of the first and second conditions for determining the first maximal value Imax1 allows a precise detection of the breakage position of the arms 6 of the shading device 3.

The step E80 for determining the first maximal value Imax1 of the measured property I is thus implemented by a sliding analysis of measurements of the property I, during the winding of the screen 2 and from the unwound position, in which the screen 2 is relaxed.

In this way, the step E80 for determining the first maximal value Imax1 of the measured property I makes it possible to detect a peak of the measured property I, corresponding to the breakage position of the arms 6 of the shading device 3, while eliminating variations of the measured property I, during the winding of the screen 2 and from the unwound position, in which the screen 2 is relaxed.

Following the step E80 for determining the first maximal value Imax1 of the measured property I, the method comprises a step E90 for determining a lower end-of-travel position of the screen 2.

In practice, the step E90 for determining the lower end-of-travel position of the screen 2 is carried out using the electronic control unit 15 and, in particular, the microcontroller 9 of the electronic control unit 15.

Here, the breakage position of the arms 6 of the shading device 3 is different from the lower end-of-travel position of the screen 2.

The lower end-of-travel position of the screen 2 corresponds to a value of the measured property I below the first maximal value Imax1. Furthermore, the lower end-of-travel position of the screen 2 is located before the breakage position of the arms 6 of the shading device 3, in the unwinding direction of the screen 2.

The determined lower end-of-travel position of the screen 2 makes it possible to delimit the displacement travel of the screen 2 of the shading device 3, as well as of the arms 6, during the unwinding of the screen 2 in the control mode.

Here, during the step E90 for determining the lower end-of-travel position of the screen 2, the lower end-of-travel position of the screen 2 is calculated automatically, in particular by the electronic control unit 15, based on the determined first maximal value Imax1, during step E80.

Thus, the lower end-of-travel position of the screen 2 is determined by an offset value Δ relative to the first maximal value Imax1.

In one embodiment, the offset value Δ can be adjusted, either in the factory or during commissioning, or during a maintenance operation of the home automation unit 1, using a control point 12, 14, which may for example be a configuration tool, so as to modify the value recorded in a memory of the electronic control unit 15.

The determination of the first maximal value Imax1 of the measured property I, owing to which the breakage position of the arms 6 of the shading device 3 is detected, allows a precise determination of the lower end-of-travel position of the screen 2.

In this way, the lower end-of-travel position of the screen 2 can be determined so as to be as close as possible to the breakage position of the arms 6 of the shading device 3.

Furthermore, such a determination of the lower end-of-travel position of the screen 2 makes it possible to guarantee a maximal unwinding of the screen 2, without reaching the breakage position of the arms 6 of the shading device 3, when a command order to unwind the screen 2 is carried out by the electromechanical actuator 11, in the control mode, as well as to guarantee the tension of the screen 2.

Furthermore, the determination of the lower end-of-travel position of the screen 2 via the determination of the first maximal value Imax1 of the measured property I, representative of the breakage position of the arms 6 of the shading device 3, makes it possible to guarantee safe and reproducible positioning of the screen 2 in the lower end-of-travel position of the screen 2 and preceding the breakage position of the arms 6 of the shading device 3, when an unwinding command order of the screen 2 is executed by the electromechanical actuator 11.

The determination of the lower end-of-travel position of the screen 2 just before the breakage position of the arms 6 of the shading device 3, in the unwinding direction of the screen 2, makes it possible to limit the stresses exerted on the motorized drive device 5, so as to minimize the cost of obtaining the latter.

The determination of the lower end-of-travel position of the screen 2 can thus be implemented automatically, i.e. by software, and in particular without intervention by the user, during steps of the configuration method following the step E50 for triggering the winding of the screen 2 from the unwound position, in which the screen 2 is relaxed, in particular steps E60 to E90, and more particularly, steps E60 to E120.

The configuration method thus makes it possible to analyze the evolution of the property I, in particular the intensity, of the electric current traversing the electric motor 16 dynamically, during the winding of the screen 2, so as to detect the breakage position of the arms 6 of the shading device 3, via the first maximal value Imax1 of the measured property I, then to determine the lower end-of-travel position of the screen 2.

Preferably, after the step E90 for determining the lower end-of-travel position of the screen 2, the configuration method comprises a step E100 for signaling the determined lower end-of-travel position of the screen 2.

In practice, the signaling step E100 can be implemented by a displacement of the screen 2 controlled by the motorized drive device 5.

Preferably, the displacement of the screen 2 corresponds to a round-trip movement of the screen 2, in particular over a short distance that may for example be approximately a centimeter.

Alternatively, the signaling step E100 can be carried out by emitting a visual and/or acoustic signal via the electronic control unit 15.

Advantageously, following the step E90 for determining the lower end-of-travel position of the screen 2 and before the signaling step E100, the configuration method comprises a step for stopping the screen 2 and a step for unwinding the screen 2 by activating the motorized drive device 5, in particular supplying electrical energy to the electromechanical actuator 11, from the position of the screen 2 corresponding to the last value of the property I measured up to the determined lower end-of-travel position of the screen 2, during step E90.

Thus, the step for unwinding the screen 2 makes it possible to return the screen 2 to the lower end-of-travel position of the screen 2, after the steps E50 to E90 contributing to the determination of the lower end-of-travel position of the screen 2 during the winding of the screen 2, so as to carry out the step E100 for signaling the determined lower end-of-travel position of the screen 2, during step E90.

In one embodiment, the configuration method may comprise, following the signaling step E100, a step for confirming the determined lower end-of-travel position of the screen 2.

The step for confirming the lower end-of-travel position of the screen 2 is carried out by the user.

In one embodiment, the step for confirming the lower end-of-travel position of the screen 2 is carried out by pressing a selection element of a control point 12, 14, in particular of the remote control 14.

Advantageously, following the step E90 for automatically determining the lower end-of-travel position of the screen 2, and in particular the step E100 for signaling the determined lower end-of-travel position of the screen 2, the configuration method comprises a step E110 for storing the determined lower end-of-travel position of the screen 2.

Furthermore, following the step E90 for automatic determination of the lower end-of-travel position of the screen 2, and in particular the step E100 for signaling the determined lower end-of-travel position of the screen 2, the configuration method comprises a step E120 for stopping the screen 2 in the determined lower end-of-travel position of the screen 2, during step E90.

The step E120 for stopping the screen 2 in the determined lower end-of-travel position of the screen 2 is carried out by deactivating the motorized drive device 5.

Here, the stopping of the screen 2 in the determined lower end-of-travel position of the screen 2 is done, automatically, by the electronic control unit 15, so as to signal, to the user, the precise determined lower end-of-travel position of the screen 2, during step E90.

In practice, the step E110 for storing the lower end-of-travel position of the screen 2 is carried out using the electronic control unit 15, in particular a memory of the microcontroller 9 of the electronic control unit 15.

Furthermore, the step E110 for storing the lower end-of-travel position of the screen 2 is carried out by the electronic control unit 15, in particular by a memory of the microcontroller 9 of the electronic control unit 15, and a counting means, not shown, configured to determine the position of the bar 8 of the screen 2.

The determined lower end-of-travel position of the screen 2, during step E90, corresponds to a counting increment value S.

In one example embodiment, the means for counting the position of the part 8 of the screen 2 is implemented using one or several detection sensors for the rotation of the rotor of the electric motor 16 of the electromechanical actuator 11.

In another example embodiment, the means for counting the position of the bar 8 of the screen 2 is implemented using a coder wheel driven by the winding tube 4, the coder wheel being able to comprise at least one magnet cooperating with at least one Hall effect sensor.

In another example embodiment, the means for counting the position of the bar 8 of the screen 2 is implemented using a counting element inside the microcontroller 9 of the electronic control unit 15, or a counting element associated with a clock of the electronic control unit 15.

The position of the screen 2 determined during the step E90 and stored during step E110 corresponds to a lower end-of-travel learning position of the screen 2. As mentioned above, this lower end-of-travel position of the screen 2, determined during step E90, is a position of the screen 2 preceding the breakage position of the arms 6 of the shading device 3, when an unwinding command order of the screen 2 is executed by the electromechanical actuator 11, in the control mode.

The lower end-of-travel position of the screen 2, determined during step E90, is used during an unwinding of the screen 2, in the control mode of the motorized drive device 5, so as to stop the screen 2 in the lower end-of-travel position of the screen 2 and as close as possible to the breakage position of the arms 6 of the shading device 3.

In the case where the lower end-of-travel position of the screen 2 determined by the electronic control unit 15 is inadequate, the configuration method comprises a step E130 for manually modifying the lower end-of-travel position of the screen 2, in particular through elements for selecting a control point 12, 14, in particular of the remote control 14.

Advantageously, following the step E130 for manually modifying the lower end-of-travel position of the screen 2, the configuration method comprises a step E140 for storing the modified lower end-of-travel position of the screen 2.

Preferably, following the step E90 for determining the lower end-of-travel position of the screen 2, and in particular, the step E120 for stopping the screen 2, or following the step E130 for manually modifying the lower end-of-travel position of the screen 2, and in particular, the step E140 for storing the modified lower end-of-travel position of the screen 2, the configuration method comprises a step E150 for continuing the winding of the screen 2.

The step E150 for continuing the winding of the screen 2 is carried out by activating the motorized drive device 5, so as to fold the screen 2, as well as the arms 6.

In one embodiment, the activation of the motorized drive device 5 is carried out automatically by the electronic control unit 15, following the step E120 for stopping the screen 2 or the step E140 for storing the modified lower end-of-travel position of the screen 2.

Alternatively, the activation of the motorized drive device 5 is done by pressing on a selection element of a control point 12, 14, in particular of the remote control 14.

Here, the selection element of the control point 12, 14 is the selection element for the winding of the screen 2.

Then, the method comprises a step E160 for continuing to measure the property I, as illustrated in FIG. 6, and a step E170 for determining a second maximal value Imax2 of the measured property I.

In practice, the step E170 for determining the second maximal value Imax2 is carried out using the electronic control unit 15, and in particular, the measuring device 25 and the microcontroller 9 of the electronic control unit 15.

Advantageously, the step E160 for continuing to measure the property I of the electric current is carried out periodically.

By way of non-limiting example, the step E160 for continuing to measure the property I is carried out every 5 milliseconds.

Following the step E170 for determining the second maximal value Imax2 of the measured property I, the method comprises a step E180 for determining an upper end-of-travel position of the screen 2.

In practice, the step E180 for determining the upper end-of-travel position of the screen 2 is carried out using the electronic control unit 15, and in particular the microcontroller 9 of the electronic control unit 15.

The upper end-of-travel position of the screen 2 corresponds to a measured value of the property I less than or equal to the second maximal value Imax2.

Furthermore, the upper end-of-travel position of the screen 2 can correspond to a closed position of the box 24 by the bar 8.

The determined upper end-of-travel position of the screen 2 makes it possible to delimit the displacement travel of the screen 2 of the shading device 3, as well as of the arms 6, during the winding of the screen 2.

Here, during the step E180 for determining the upper end-of-travel position of the screen 2, the upper end-of-travel position 2 is determined automatically, in particular by the electronic control unit 15, based on the determined second maximal value Imax2, during step E170.

Thus, the step E90 for automatic determination of the lower end-of-travel position of the screen 2 can also be associated with a step E170 for automatic determination of an upper end-of-travel position of the screen 2.

The steps E90, E170 for automatic determination of the lower and upper end-of-travel positions of the screen 2 can be applied consecutively, in particular following a same step E50 for triggering the winding of the screen 2.

Such a configuration method, in which the determination of the lower end-of-travel position of the screen 2, and optionally, the determination of the upper end-of-travel position of the screen 2 are done by software via the electronic control unit 15 of the electromechanical actuator 11, makes it possible to minimize the costs of obtaining and commissioning the motorized drive device 5 and to eliminate additional parts.

We now describe, in reference to FIG. 5, one embodiment of a method for controlling the operation of the motorized drive device 5 of the home automation unit 1 illustrated in FIGS. 1 to 3.

The method for controlling the operation of the motorized drive device 5 comprises a step E200 for triggering the unwinding of the screen 2, a step E210 for counting the position of the bar 8 of the screen 2, a step E220 for comparing a counting value of the position of the bar 8 of the screen 2, determined during step E210, relative to the counting increment value S corresponding to the lower end-of-travel position of the screen 2 determined according to the configuration method, and a step E230 for determining whether the lower end-of-travel position of the screen 2 has been reached or not by the electronic control unit 15 of the electromechanical actuator 11, based on the result of the comparison step E220.

The counting increment value S taken into consideration to determine whether the lower end-of-travel position of the screen 2 has been reached or not, during the control mode of the motorized drive device 5, is a value that is determined in the step E90 for determining the lower end-of-travel position of the screen 2 of the configuration method or the step E130 for manually modifying the lower end-of-travel position of the screen 2 of the configuration method.

The control method is implemented following the configuration of the motorized drive device 5, so as to determine, following the comparison, in step E220, a counting value of the position of the bar 8 of the screen 2, determined during step E210, relative to the determined counting increment value S, during step E90 or E130 of the configuration method, whether the lower end-of-travel position of the screen 2 has been reached or not by the electronic control unit 15 of the electromechanical actuator 11, based on the result of the comparison.

In this way, the detection of the lower end-of-travel position of the screen 2 by the electronic control unit 15 of the electromechanical actuator 11, during the unwinding of the screen 2, is precise and reliable, so as to be as close as possible to the breakage position of the arms 6 of the shading device 3, in particular while being independent of environmental factors of the motorized drive device 5, such as for example the outside temperature or the outside humidity of the motorized drive device 5.

The reaching of the lower end-of-travel device of the screen 2 is determined when the counting position of the bar 8 of the screen 2 is equal to the counting increment value S determined according to the configuration method.

Furthermore, failure to reach the lower end-of-travel position of the screen 2 is determined when the counting value of the position of the bar 8 of the screen 2 is different from, in particular lower than, the counting increment value S determined according to the configuration method.

Preferably, the step E220 for comparing the counting value of the position of the bar 8 of the screen 2 relative to the counting increment value S is done periodically, while the result of the step E230 for determining whether the lower end-of-travel position of the screen 2 has been reached or not by the electronic control unit 15 of the electromechanical actuator 11 is different from reaching of the lower end-of-travel position by the screen 2.

Such a control method in which the determination of the lower end-of-travel position of the screen 2, during an unwinding of the screen 2, is done by software by the electronic control unit 15 of the electromechanical actuator 11 makes it possible to minimize the costs of obtaining the motorized drive device 5.

In practice, the step E220 for comparing the counting value of the position of the bar 8 of the screen 2 relative to the determined counting increment value S is carried out using the electronic control unit 15, and in particular, the microcontroller 9 of the electronic control unit 15.

Owing to the present invention, the determination of the first maximal value of the measured property, owing to which the breakage position of the arms of the shading device is detected, enables a precise determination of the lower end-of-travel position of the screen.

In this way, the lower end-of-travel position of the screen can be determined so as to be as close as possible to the breakage position of the arms of the shading device.

Many modifications can be made to the example embodiments previously described without going beyond the scope of the invention defined by the claims.

In particular, the electric motor of the electromechanical actuator can be of the asynchronous or DC type.

Furthermore, the measured property I of the electric current traversing the electric motor 16 can be different from its intensity. It may in particular involve its voltage.

Alternatively, the configuration method of the motorized drive device of the home automation unit can be implemented through a control point corresponding to a configuration tool.

Furthermore, the embodiments and alternatives considered here can be combined to generate new embodiments of the invention, without going beyond the scope of the invention defined by the claims.

The invention claimed is:

1. A method for configuring a motorized drive device for a solar protection home automation unit, the solar protection home automation unit comprising a shading device, the shading device comprising at least:

a winding tube, a screen, a first end of the screen being fastened to the winding tube, a bar, a second end of the screen being fastened to the bar, and at least two arms, a first end of each of the arms being fastened to the bar and a second end of each of the arms being fastened to a support structure of the shading device, the motorized drive device comprising at least:

an electromechanical actuator making it possible to wind and unwind the screen on the winding tube, and to fold and unfold the arms, the electromechanical actuator comprising at least:

an electric motor, an output shaft connected to the winding tube of the shading device, and an electronic control unit, the electronic control unit comprising at least:

a device for measuring a property of an electric current traversing the electric motor, and a memory storing at least one value of the measured property, wherein said method comprises at least the following steps:

a first step for triggering the winding of the screen, from an unwound position, in which the screen is relaxed, to a wound position, a second step for measuring the property of the electric current traversing the electric motor via the measuring device, a third step for determining a first maximal value of the measured property, the first maximal value being representative of a breakage position of the arms of the shading device, and a fourth step for determining a lower end-of-travel position of the screen, where the lower end-of-travel position of the screen corresponds to a value of the measured property below the first maximal value, and where the lower end-of-travel position of the screen is located before the breakage position of the arms of the shading device, in the unwinding direction of the screen.

2. The method for configuring a motorized drive device for a solar protection home automation unit according to claim 1, wherein, prior to the first step for triggering the winding of the screen, said method comprises at least the following steps:

a fifth step for triggering the unwinding of the screen from a wound position to the unwound position, in which the screen is relaxed, and a sixth step for stopping the screen in the unwound position, in which the screen is relaxed.

3. The method for configuring a motorized drive device for a solar protection home automation unit according to claim 1, wherein, following the fourth step for determining the lower end-of-travel position of the screen, said method comprises a seventh step for signaling the determined lower end-of-travel position of the screen.

4. The method for configuring a motorized drive device for a solar protection home automation unit according to claim 1, wherein the determination of the lower end-of-travel position of the screen is done automatically, during steps of the configuration method following the first step for triggering the winding of the screen.

5. The method for configuring a motorized drive device for a solar protection home automation unit according to claim 1, wherein, following the fourth step for determining the lower end-of-travel position of the screen, the configuration method comprises at least the following steps:

an eighth step for continuing the winding of the screen, a ninth step for continuing the measurement of the property, a tenth step for determining a second maximal value of the measured property, and an eleventh step for determining an upper end-of-travel position of the screen.

6. The method for configuring a motorized drive device for a solar protection home automation unit according to claim 1, wherein the fourth step for measuring the property of the electric current is carried out periodically.

7. A motorized drive device of a solar protection home automation unit, the motorized drive device comprising at least:

an electromechanical actuator making it possible to wind and unwind a screen of a shading device of the home automation unit on a winding tube of the shading device, and to fold and unfold the arms of the shading device, the electromechanical actuator comprising at least:

an electric motor, an output shaft connected to the winding tube of the shading device, and an electronic control unit, wherein the electronic control unit of the electromechanical actuator is configured to carry out the configuration method according to claim 1.

8. A solar protection home automation unit, wherein said home automation unit comprises a motorized drive device according to claim 7.

9. A method for controlling the operation of a motorized drive device of a solar protection home automation unit, the solar protection home automation unit comprising a shading device, the shading device comprising at least:

a winding tube, a screen, a first end of the screen being fastened to the winding tube, a bar, a second end of the screen being fastened to the bar, and at least two arms, a first end of each of the arms being fastened to the bar and a second end of each of the arms being fastened to a support structure of the shading device, the motorized drive device comprising at least:

an electromechanical actuator making it possible to wind and unwind the screen on the winding tube, and to fold and unfold the arms, the electromechanical actuator comprising at least:

an electric motor, an output shaft connected to the winding tube of the shading device, and an electronic control unit, wherein said method comprises at least the following steps:

a twelfth step for triggering the unwinding of the screen, a thirteenth step for counting the position of the bar of the screen, a fourteenth step for comparing a counting value of the position of the bar of the screen, determined during the thirteenth step, relative to a counting increment value corresponding to the determined lower end-of-travel position of the screen, according to a configuration method of the motorized drive device according to claim 1, and a fifteenth step for determining whether the lower end-of-travel position of the screen has been reached or not by the electronic control unit of the electromechanical actuator, based on the results of the fourteenth comparison step.

10. The method for controlling the operation of a motorized drive device of a solar protection home automation unit according to claim 9, wherein the fourteenth step for comparing the counting value of the position of the bar of the screen relative to the counting increment value is carried out periodically, as long as the result of the fifteenth step for determining whether the lower end-of-travel position of the screen has been reached or not by the electronic control unit of the electromechanical actuator is different from reaching the lower end-of-travel position of the screen.

11. A motorized drive device of a solar protection home automation unit, the motorized drive device comprising at least:

an electromechanical actuator making it possible to wind and unwind a screen of a shading device of the home automation unit on a winding tube of the shading device, and to fold and unfold the arms of the shading device, the electromechanical actuator comprising at least:

an electric motor, an output shaft connected to the winding tube of the shading device, and an electronic control unit, wherein the electronic control unit of the electromechanical actuator is configured to carry out the operating control method according to claim 9.

12. A solar protection home automation unit, wherein said home automation unit comprises a motorized drive device according to claim 11.

* * * * *